US009724836B2

(12) United States Patent
Bond

(10) Patent No.: US 9,724,836 B2
(45) Date of Patent: Aug. 8, 2017

(54) ROOF PIPE FLASHING

(76) Inventor: William Ralph Bond, Manassas, VA (US)

( * ) Notice: Subject to any disclaimer, the term of this patent is extended or adjusted under 35 U.S.C. 154(b) by 1110 days.

(21) Appl. No.: 13/507,134

(22) Filed: Jun. 7, 2012

(65) Prior Publication Data

US 2013/0328300 A1 Dec. 12, 2013

(51) Int. Cl.

| | |
|---|---|
| ***E04D 13/00*** | (2006.01) |
| ***B26D 3/00*** | (2006.01) |
| ***B26F 3/02*** | (2006.01) |
| ***E04D 13/147*** | (2006.01) |

(52) U.S. Cl.
CPC ..... *B26D 3/00* (2013.01); *B26F 3/02* (2013.01); *E04D 13/1476* (2013.01); *Y10T 83/04* (2015.04); *Y10T 225/10* (2015.04)

(58) Field of Classification Search
CPC ..... E04D 13/1476; E04D 13/1475
USPC ..... 285/42–44, 4, 3; 52/219, 100
See application file for complete search history.

(56) References Cited

U.S. PATENT DOCUMENTS

| | | | | | |
|---|---|---|---|---|---|
| 928,596 | A | * | 7/1909 | Friedman | 4/288 |
| 2,173,037 | A | * | 9/1939 | Dailey | 285/123.4 |
| 3,163,101 | A | * | 12/1964 | Caparrelli | 454/1 |
| 3,602,530 | A | * | 8/1971 | Elwart | 285/4 |
| 3,638,503 | A | * | 2/1972 | Stipanovic et al. | 74/18 |
| 3,797,181 | A | | 3/1974 | Nievelt | |
| 3,905,165 | A | * | 9/1975 | Kneisel | E04D 1/365 52/276 |
| 4,526,407 | A | | 7/1985 | Kifer | |
| 4,563,847 | A | * | 1/1986 | Hasty | 52/219 |
| 4,903,997 | A | | 2/1990 | Kifer | |
| 5,036,636 | A | | 8/1991 | Hasty | |
| 5,176,408 | A | * | 1/1993 | Pedersen | 285/42 |
| 5,222,334 | A | | 6/1993 | Hasty | |
| 5,226,263 | A | | 7/1993 | Merrin et al. | |
| 5,245,804 | A | | 9/1993 | Schiedegger et al. | |
| 5,588,267 | A | | 12/1996 | Rodriguez et al. | |
| 2005/0150176 | A1 | | 7/2005 | Erekson | |
| 2006/0130411 | A1 | | 6/2006 | Edgar et al. | |
| 2011/0219723 | A1 | | 9/2011 | Manning | |

FOREIGN PATENT DOCUMENTS

| | | | | | |
|---|---|---|---|---|---|
| DE | 2523575 | A1 | * | 12/1975 | E04D 13/1475 |
| FR | 649177 | A | * | 12/1928 | E04D 13/1476 |
| GB | 300435 | | | 11/1928 | |

* cited by examiner

*Primary Examiner* — David E Bochna
*Assistant Examiner* — James A Linford
(74) *Attorney, Agent, or Firm* — Palmer C. DeMeo; Palmer Patent Consultants, LLC

(57) ABSTRACT

A roof pipe flashing with a raised boot and elongated opposite extensions extending therefrom which roof pipe flashing is used to cover and weatherproof an existing but damaged roof pipe flashing on the pitched roof of a building. The roof pipe flashing can be made manually by cutting or tearing along pre-marked lines on the flat base of a roof pipe flashing.

9 Claims, 6 Drawing Sheets

ROOF PIPE FLASHING

BACKGROUND OF THE INVENTION

1. Field of the Invention

The present invention relates to a roof pipe flashing and particularly the repair of a damaged roof pipe flashing.

2. Description of the Related Art

A problem which can occur over time with vent pipes extending through the roof of a building is deteriorization of the flashing boot surrounding the vent pipe causing water leakage therethrough and subsequent damage to the roofing structure. Several prior art methods have been used to repair existing roof pipe flashings by covering the boot of the existing roof pipe flashing with a similar shaped boot over the existing boot in order to prevent water leakage. One such method is disclosed in the publication US 2001/0219723 where a vent pipe cover comprising a cylindrical sheath portion joined to a flaring boot portion is used. The cylindrical sheath portion is slid over the cylindrical vent pipe and the flaring boot portion is placed over an existing roof boot. The vent pipe cover of the publication also includes an accordion pleat between the cylindrical sheath portion and the flaring boot portion to compensate for roof pitch angle. The vent pipe cover of the publication further includes spaced friction rings between the cylindrical sheath portion and the cylindrical vent pipe in order to hold the cylindrical sheath portion in place. Another prior art method is disclosed in the publication US 2005/01501176 where a truncated conical shield or cover is placed over a damaged boot portion of an existing roof pipe flashing. Other prior art covers for existing roof pipe flashings are disclosed in the following patents: U.S. Pat. No. 3,163,101, U.S. Pat. No. 3,797,181, U.S. Pat. No. 5,226,263, U.S. Pat. No. 5,245,804 and US publication 2006/0130411.

SUMMARY OF THE INVENTION

The purpose of this invention is to provide a water tight cover for an existing but damaged roof pipe flashing without removing the damaged roof pipe flashing and to accomplish this in an expeditious way saving time and without removal of the damaged roof pipe flashing from the roof of a building. In order to accomplish this, a modified roof pipe flashing is used to cover the damaged boot of an existing roof pipe flashing. The roof pipe flashing of this invention includes a boot generally about the same size as the boot of an existing but damaged roof pipe flashing and a pair of opposite extensions from the boot which extensions are used to secure the boot to the roof of the building via the base of the existing but damaged roof pipe flashing. The roof pipe flashing of this invention can be a prefabricated cover boot including opposite elongated extensions or it can be fabricated from a commercially available roof pipe flashing by manually cutting or tearing the pre-marked base of the commercially available roof pipe flashing in order to manually fabricate a cover boot with opposite extensions.

It is an object of this invention to provide a roof pipe flashing to cover the damaged boot of an existing roof pipe flashing.

It is another object of this invention to prevent water leakage from an existing but damaged roof pipe flashing.

It is a further object of this invention to use a roof pipe flashing to repair an existing but damaged roof pipe flashing without tearing up or replacing the base of the existing but damaged roof pipe flashing.

It is another object of this invention to save time in repairing an existing but damaged roof pipe flashing.

It is a further object of this invention to modify a commercially available roof pipe flashing which is partially fabricated on site or completely prefabricated at the factory.

It is yet another object of this invention to use a pre-marked roof pipe flashing as a new roof pipe flashing for new roof construction.

DETAILED DESCRIPTION OF THE PREFERRED EMBODIMENTS

Figure 1:
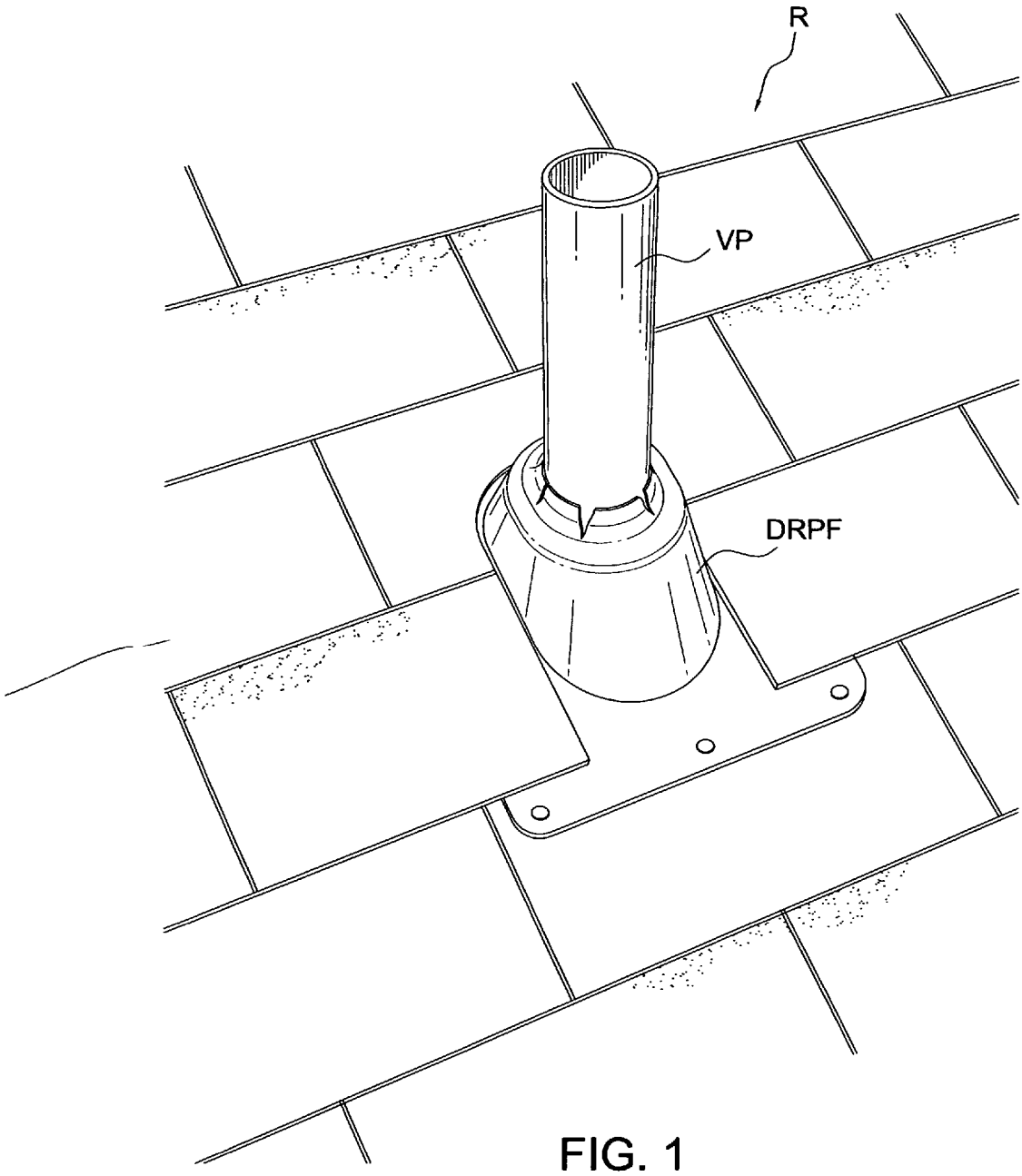
FIG. 1 is a perspective view of a damaged boot of a roof pipe flashing on an inclined or pitched roof of a building.

FIG. 1 shows a damaged boot of an existing roof pipe flashing (DRPF) for a vent pipe VP which would result in water leakage and probable damage to the roof R of a building. This is the type of damage that the roof pipe flashing of this invention intends to repair.

Figure 2:
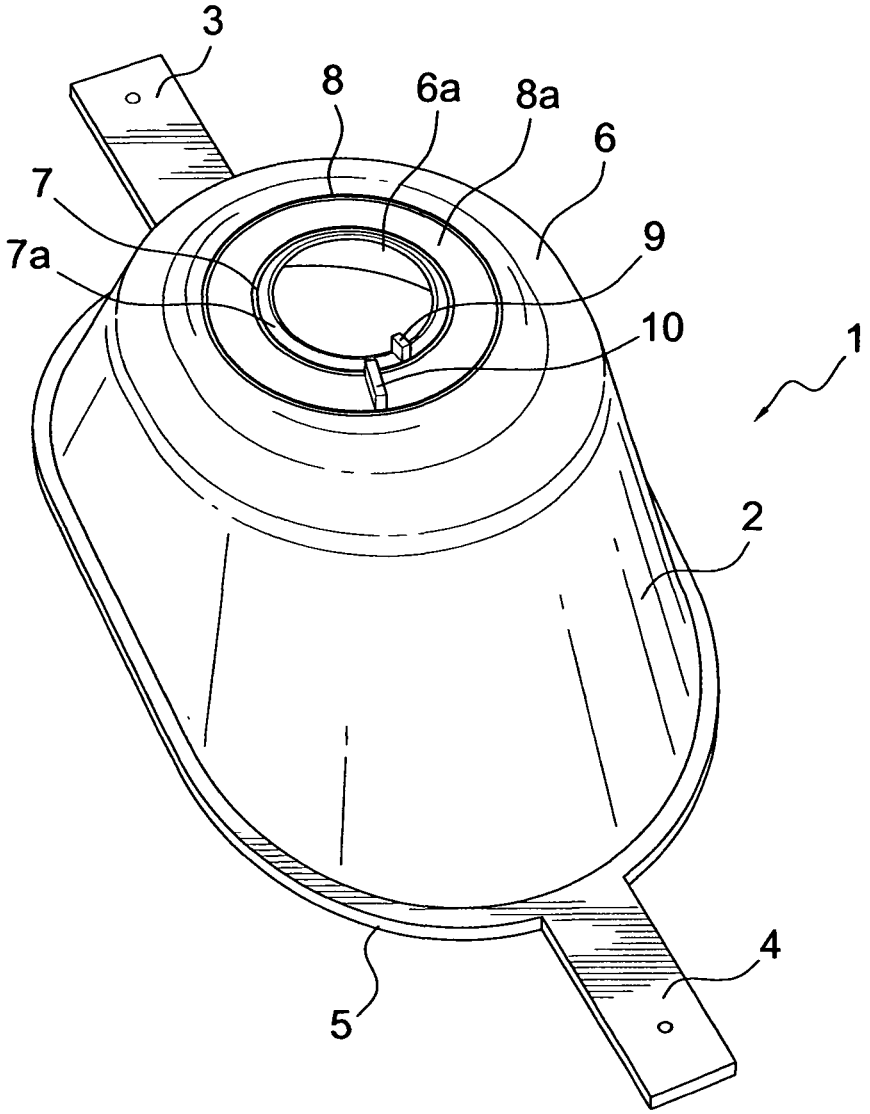
FIG. 2 is a perspective view of the roof pipe flashing of this invention.

Referring to FIG. 2, there is shown the roof pipe flashing 1 of this invention. The roof pipe flashing 1 includes a raised boot 2 and two extensions 3 and 4 extending from opposite sides at the bottom end 5 of the raised boot 2. The extensions 3 and 4 are used to anchor the raised boot to the roof R of the building. The extensions 3 and 4 preferably extend from about three inches from the bottom end 5 of the raised boot 2 but can vary somewhat longer or shorter. The width of each extension is approximately two inches but can vary somewhat wider or narrower. The raised boot 2 is somewhat frusto-conical in shape and has an opening 6*a* at the top end 6 thereof to accommodate a vent pipe VP extending therethrough. The raised boot 2 of the roof pipe flashing 1 of this invention is generally of the same size as the boot of an existing but damaged roof pipe flashing DRPF in order to be readily placed thereover. The top end 6 of the raised boot 2 has a couple of marked circles 7 and 8 of different diameters which can be used to cut out or tear out a circumferential sections 7*a* or 8*a* at the top end 6 in order to accommodate different sized vent pipes. Upright tabs 9 and 10 extending from the separate sized circumferential sections 7*a* and 8*a* can be used to aid in the manual removal of the circumferential sections. The roof pipe flashing of this invention 1 is made from soft rubbers, hard plastics or conventional elastomeric materials.

Figure 3A:
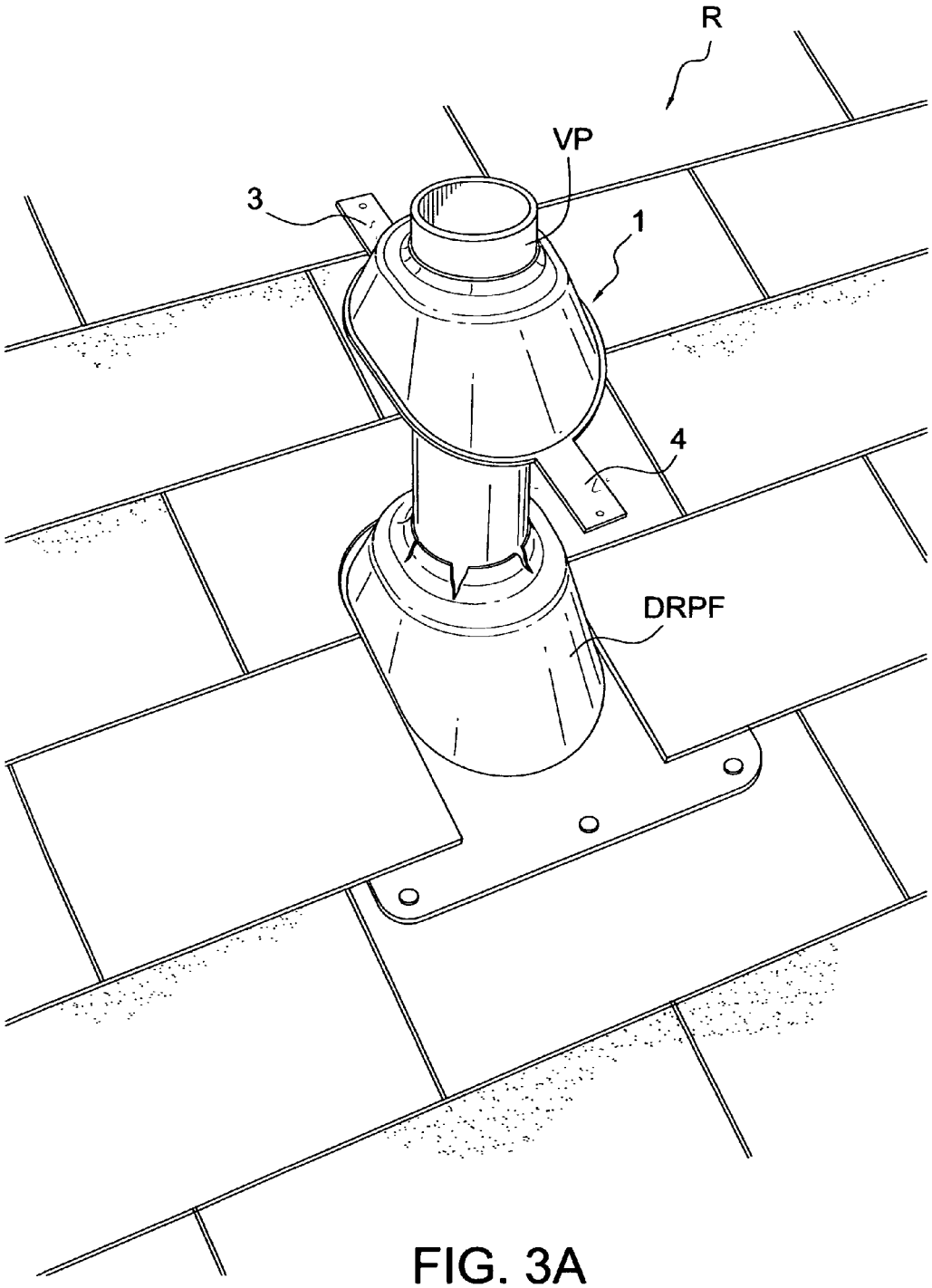
FIG. 3*a* is a perspective view of the roof pipe flashing of this invention being installed over the damaged boot of the roof pipe flashing of FIG. 1.
Figure 3B:
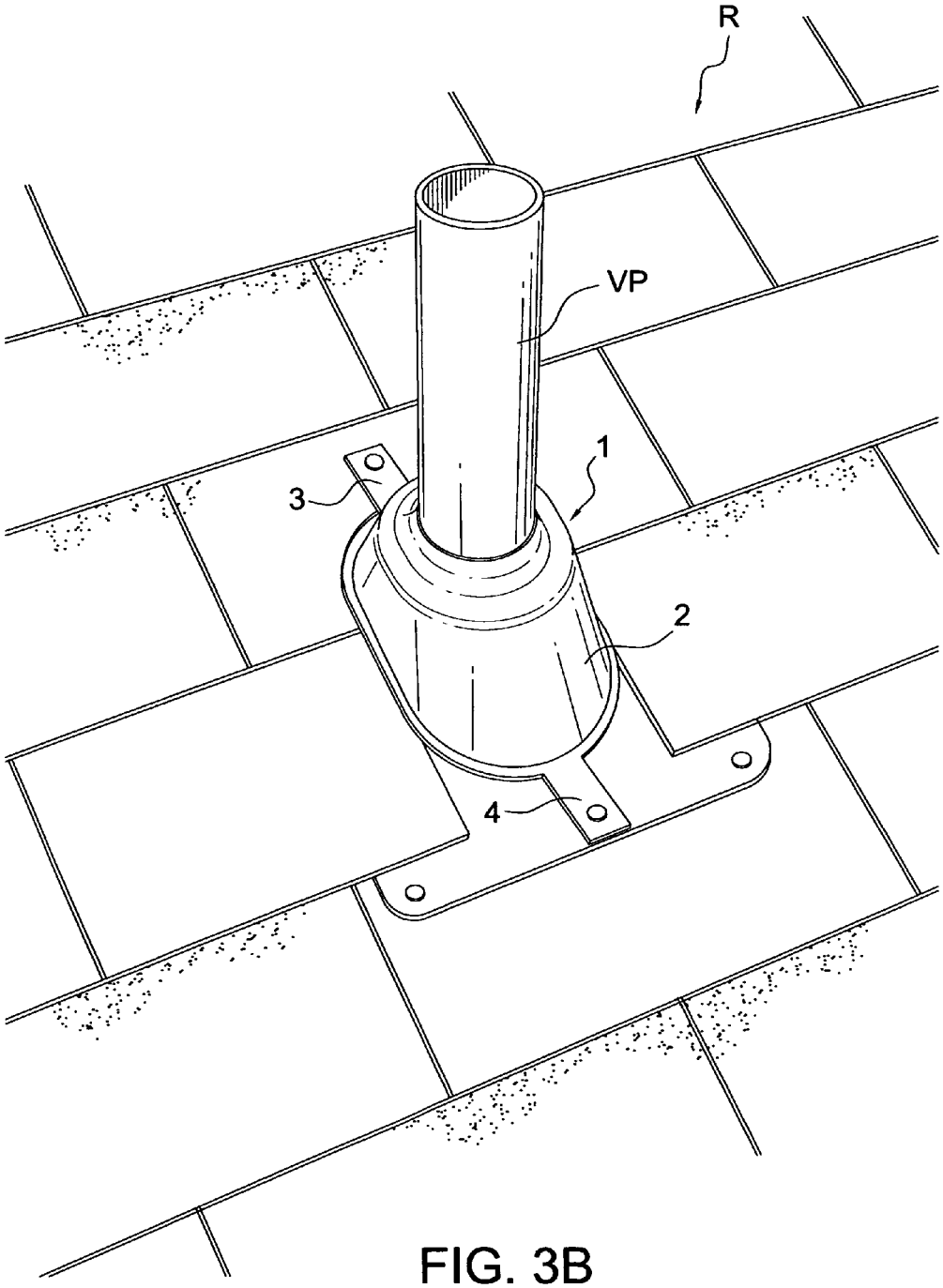
FIG. 3*b* is a perspective view of the roof pipe flashing of this invention with the cover boot being completely installed over the damaged boot of the roof pipe flashing of FIG. 1.

Referring now to FIG. 3*a*, there is shown the positioning of the roof pipe flashing 1 of this invention partially slid down over the vent pipe VP of a damaged roof pipe flashing (DRPF) on the pitched roof R of a building. In FIG. 3*b* there is shown the raised boot 2 of the present invention completely covering the damaged boot of the roof pipe flashing (DRPF) shown in FIG. 1. Also shown in FIG. 3*b* is the semi-closed top end 6 making a tight frictional engagement between the circumferential section surrounding the opening 6*a* and the outer cylindrical surface of the vent pipe VP which engagement will provide a weather-proof and water tight protection of the damaged roof pipe flashing (DRPF). The roof pipe flashing 1 of this invention is secured to the roof of the building by nails or screws at the free ends of the extensions 3 and 4 as shown in FIG. 3*b*. Each of the free ends of the extensions 3 and 4 may be initially provided with a hole to accommodate a nail or screw therethrough. In some instances the roof pipe flashing 1 of this invention may not completely cover the damaged roof pipe flashing DRPF all the way down to the roof R such that the bottom end 5 of the roof pipe flashing 1 is touching the roof shingles but that the raised boot 2 of the roof pipe flashing 1 of this invention is sufficiently covering a substantial portion of the damaged boot of the damaged roof pipe flashing DRPF by frictionally engaging and surrounding the vent pipe VP such that the roof pipe flashing 1 of this invention is effective in preventing water leakage therethrough or further weather damage thereto.

Figure 4:
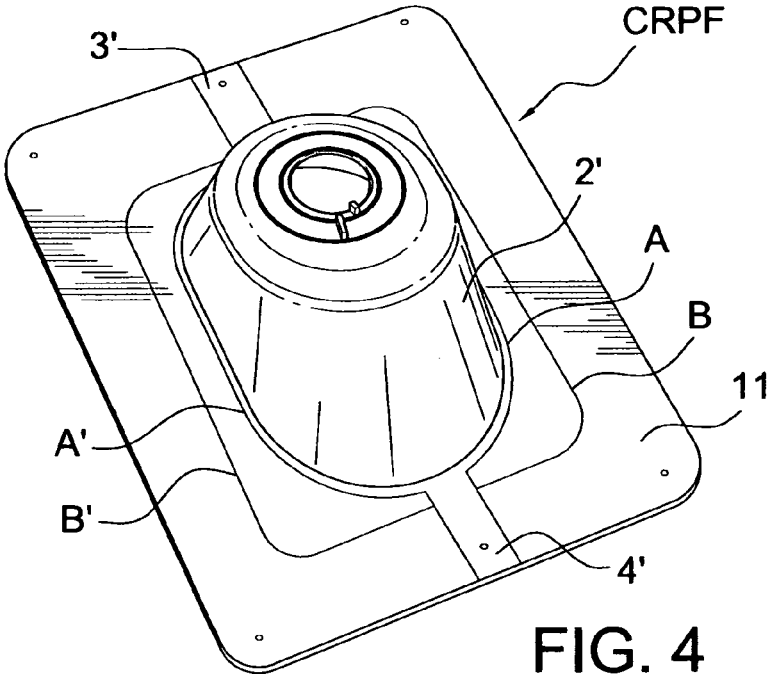
FIG. 4 is a perspective view of a conventional roof pipe flashing from which the roof pipe flashing of this invention can be manually fabricated.

FIG. 4 shows a conventional roof pipe flashing (CRPF) from which the roof pipe flashing 1 of this invention can be manually fabricated. The conventional roof pipe flashing (CRPF) includes a rectangular-shaped, flat support base 11, a frusto-conical shaped raised boot 2' extending therefrom and a cut-out or marked lines A, A' and B, B' on the upper surface of the flat support base 11. Details of the cut-out or marked lines A, A' and B, B' are explained more fully below with respect to FIG. 5. The rectangular-shaped, flat support base 11 has dimensions of approximately 12 inches by 15 inches. The raised boot 8 has an oval shaped bottom end whose dimensions are: approximately 7 and ¾ inches (major axis) and 5¼ inches (minor axis); a front wall length of approximately 4½ inches and a rear wall length of approximately 1¾ inches. The raised boot 2' has a domed shaped oval upper end with a central aperture for the roof vent pipe VP. The dimensions of the domed shaped oval upper end are: approximately 5½ inches (major axis) and 4 and ¾ inches (minor axis) and a central opening diameter of approximately 1 and ⅜ inches. These dimensions can vary depending on the size of the roof pipe flashing used but generally these dimensions are appropriate for the conventional roof pipe flashing used on housing roofs today. The domed shaped upper end of the boot 2' is at an angle with respect to the bottom oval end of the boot 2'. The conventional roof pipe flashing (CRPF) is made from an elastomeric material. An example of a conventional roof pipe flashing (CRPF) that can be used for the present invention is disclosed in U.S. Pat. No. 4,903,997.

Figure 5:
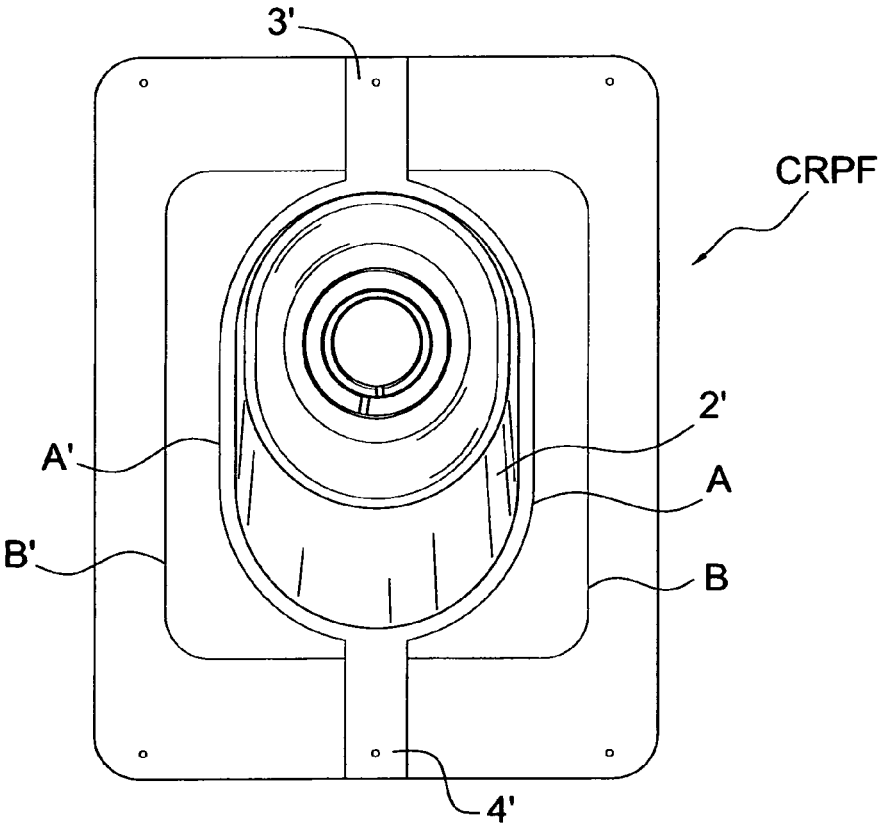
FIG. 5 is a top planar view of the roof pipe flashing shown In FIG. 4 showing cut-out lines on the base thereof by which the roof pipe flashing of this invention can be manually fabricated.

FIG. 5 shows a top planar view of a pre-marked conventional roof pipe flashing (CRPF) from which the roof pipe flashing 1 of this invention can be manually fabricated. The cut-out or marked lines A, A' and B, B' are clearly shown on the flat support base 11. The cut-out or marked lines A, A' surround opposite sides of the raised boot 2' at approximately ⅜ inch from the bottom end 5 thereof but can be varied therefrom and also outlines two opposite extensions 3' and 4' extending therefrom. Each of the opposite extensions 3' and 4' is approximately 3 inches long and 2 inches wide but these dimensions can be varied. The cut-out or marked lines A, A' and B, B' can be color coated lines, raised lines or shallow engraved lines. Cut-out or marked lines A, A' indicate the directions for cutting out or tearing out the roof pipe flashing 1 of the present invention as shown in FIG. 2 of the drawing. Although only two sets of cut-out or marked lines are particularly described herein other configurations of cut-out or marked lines on the flat support base 11 could also be used provided that the opposite extensions 3' and 4' from the bottom end 5 of the raised boot 2' are maintained. It is also possible to only have cut-out or marked lines on the flat support base 11 defining the two opposite extensions 3' and 4' with no marked lines spaced around the bottom end 5 of the raised boot 2'.

Figure 6:
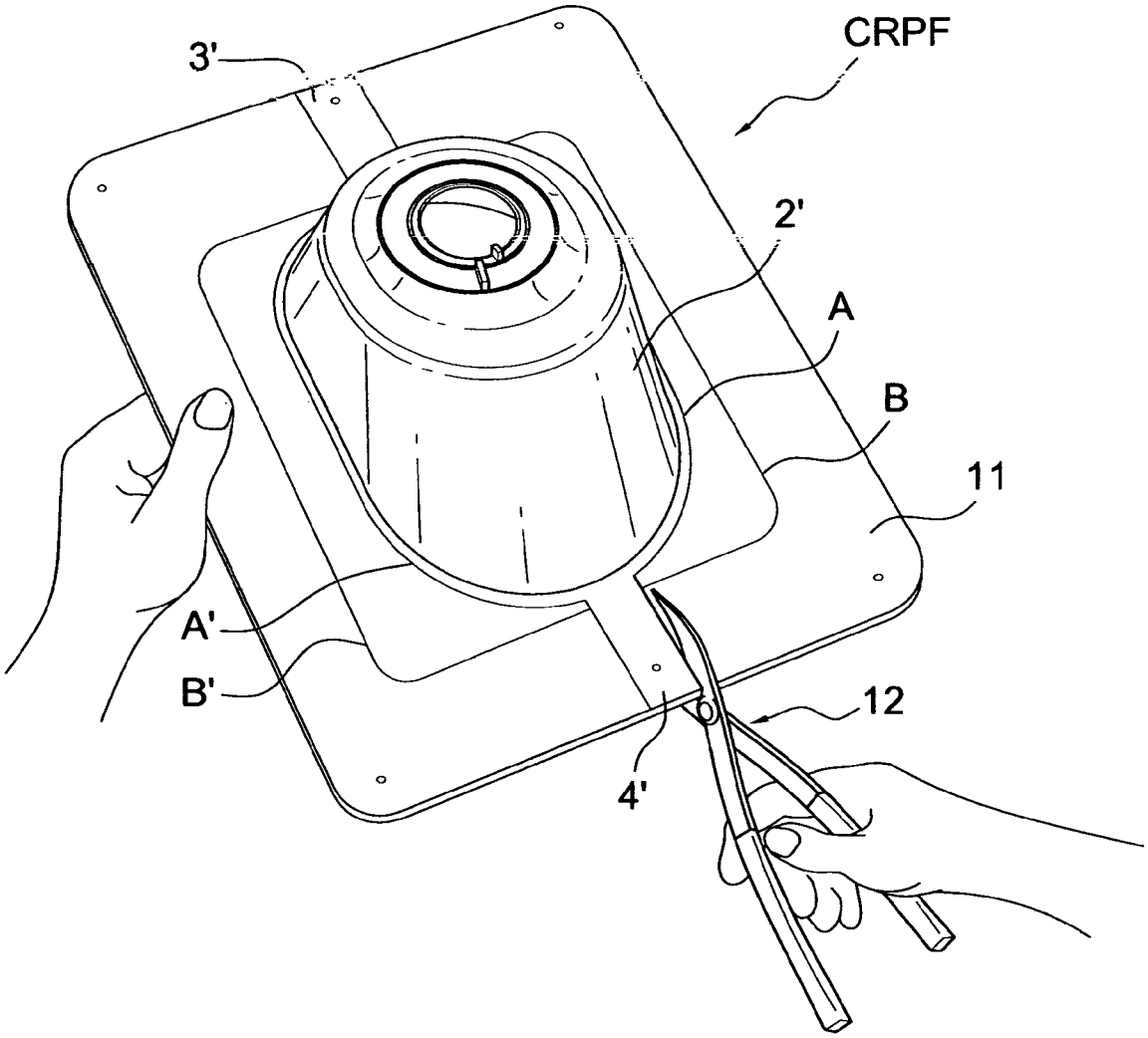
FIG. 6 shows the use of a construction snips for cutting the roof pipe flashing along the cut-out lines of the roof pipe flashing of this invention.

Referring now to FIG. 6, there is shown one method for manually fabricating the roof pipe flashing 1 of this invention by simply and separately cutting along each marked line A and A' with a pair of construction snips 12 or other known cutting tools by holding the flat support base 11 with one hand and separately cutting along each marked line A and A' with the construction snips 12 in the opposite hand. The roof pipe flashing 1 of this invention, as shown in FIG. 2, will result by effecting this cutting procedure.

As an alternative method for manually fabricating the roof pipe flashing 1 of this invention, each marked line A and A' can be a hollow engraved line which is tearable by hand. In which case, the roofer or construction worker can separately tear opposite sections of the flat support base 11 by using both hands such that the roof pipe flashing 1 of this invention, as shown in FIG. 2, will result.

An alternative roof pipe flashing 1' of this invention can be realized by manually cutting or tearing out the base sections of the flat support base 11 along the marked lines B and B' in which case a reduced rectangular base supporting a raised boot 2' with opposite extensions 3' and 4' will result. This resulting roof pipe flashing 1' would also be effective in covering and repairing an existing but damaged roof pipe flashing (DRPF) in a manner similar to the roof pipe flashing 1.

It is also intended to use the pre-marked roof pipe flashing of this invention in the new construction for a roof of a building.

Although the present specification discloses methods by which the roof pipe flashing 1 of this invention can be manually fabricated from a conventional roof pipe flashing, the roof pipe flashing 1 of this invention could also be pre-fabricated at a factory using mechanized cutting or tearing techniques well known in the manufacturing art.

Modification of this invention will be readily apparent to those skilled in the art and it is intended that the invention be not limited by the embodiments disclosed herein but that the scope of the invention be defined by the appended claims.

What is claimed is:

1. A roof pipe flashing for covering a damaged roof pipe flashing on a shingled roof of a building comprising a boot having a frusto-conical wall, said frusto-conical wall having a semi-closed top end and an open bottom end, said semi-closed top end having an opening therein for passing a roof vent pipe therethrough, said opening having a diameter such as to provide a water tight frictional engagement with said roof vent pipe, said semi-closed top end being at an inclined angle with respect to said open bottom end, said open bottom end of said frusto-conical wall having an opening large enough to provide a complete covering of said damaged roof pipe flashing with said boot, said open bottom end of said frusto-conical wall having an outer circumferential width at said open bottom end of said frusto-conical wall, said roof pipe flashing has a first configuration comprising an external flat support base monolithically formed with said open bottom end of said frusto-conical wall, said flat support base completely surrounds and abuts said frusto-conical wall and said flat support base's outer most peripheral widths and lengths is rectangularly shaped, a surface of said flat support base, which surface faces said frusto-conical wall, contains marked lines which define an outer most periphery of a second configuration, and said second configuration comprising an external flat strip monolithically formed with said open bottom end of said frusto-conical wall and said flat strip completely surrounds and abuts said frusto-conical wall, said flat strip is formed by removing material that formed said flat support base, along said marked lines, and said flat strip being transversely narrower in width than said widths of said flat support base, wherein said widths are transverse with respect to said frusto-conical wall, said second configuration further comprises at least one flat elongated extension, said flat elongated extension being monolithically formed with and in the same plane as said flat strip and is formed by removing material that formed said flat support base, along said marked lines, said outer most peripheral width of said flat elongated extension being narrower than said outer most periphery widths of said flat support base and said flat elongated extension's outer most length terminating at a same length as one of said outer most peripheral lengths of said flat support base, said at least one flat elongated extension having a free end, and said at least one flat elongated extension having means at said free end for securing said boot over said damaged roof pipe flashing to said roof of said building.

2. The roof pipe flashing of claim 1 wherein said external flat strip has a width less than said second width of said at least one elongated extension.

3. The roof pipe flashing of claim 1 wherein said roof of said building is shingled, said shingled roof having an upper surface, and said at least one elongated extension is secured over said upper surface of said shingled roof by said means.

4. The roof pipe flashing of claim 1 wherein said semi-closed top end of said boot has an upper surface with at least one marked circle surrounding said opening for cutting a larger opening therein to accommodate a larger diameter vent pipe.

5. The roof pipe flashing of claim 4 wherein said at least one marked circle is defined by a mark selected from the group consisting of a color coating, a raised line and an engraved line.

6. The roof pipe flashing of claim 5 wherein there is a circumferential strip between said at least one marked circle and said top end opening and a protruding tab extending upwardly from said circumferential strip.

7. The roof pipe flashing of claim 1 wherein said roof pipe flashing is made from a material selected from the group consisting of rubbers and plastics.

8. The roof pipe flashing of claim 1 wherein said roof pipe flashing is made from elastomeric material.

9. The roof pipe flashing of claim 1 wherein said at least one flat elongated extension includes two flat elongated extensions oppositely connected, directly and integrally, to said external flat strip such that said frusto-conical wall, said external flat strip, and said two flat elongated extensions form a monolithic structure.

* * * * *